US010059111B2

(12) United States Patent
Otagiri et al.

(10) Patent No.: US 10,059,111 B2
(45) Date of Patent: Aug. 28, 2018

(54) MAINTENANCE UNIT AND LIQUID EJECTING APPARATUS

(71) Applicant: SEIKO EPSON CORPORATION, Tokyo (JP)

(72) Inventors: Yoshihiro Otagiri, Azumino (JP); Masaki Shimomura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/340,467

(22) Filed: Nov. 1, 2016

(65) Prior Publication Data

US 2017/0129243 A1 May 11, 2017

(30) Foreign Application Priority Data

Nov. 6, 2015 (JP) ..... 2015-218096

(51) Int. Cl.
*B41J 2/17* (2006.01)
*B41J 2/165* (2006.01)

(52) U.S. Cl.
CPC ..... *B41J 2/16511* (2013.01); *B41J 2/1721* (2013.01)

(58) Field of Classification Search
CPC .. B41J 2/16511; B41J 2/1721; B41J 2/16523; B41J 2002/1728–2002/1742; B41J 2/1652–2/1629; B41J 2002/1853–2002/1856
See application file for complete search history.

(56) References Cited

U.S. PATENT DOCUMENTS 6,116,719 A * 9/2000 Maza ..... B41J 2/1652 347/22
6,174,041 B1 * 1/2001 Urrutia ..... B41J 2/1652 347/22
6,739,694 B2 * 5/2004 Okamura ..... B41J 2/16523 347/29
8,905,514 B1 * 12/2014 Kishigami ..... B41J 2/16511 347/29
9,227,407 B1 * 1/2016 Harada ..... B41J 2/16517
2006/0197798 A1 * 9/2006 Hsu ..... B41J 2/16547 347/33
2007/0252864 A1 11/2007 Uchino
2009/0218271 A1 * 9/2009 Harada ..... B41J 2/16523 210/236
2009/0315943 A1 * 12/2009 Ohnishi ..... B41J 2/16523 347/36
2010/0165040 A1 * 7/2010 Ohnishi ..... B41J 2/16523 347/36
2012/0236074 A1 * 9/2012 Harada ..... B41J 2/1721 347/36
2013/0141493 A1 * 6/2013 Ohnishi ..... B41J 2/1721 347/36

(Continued)

FOREIGN PATENT DOCUMENTS

JP 2007-296757 A 11/2007

*Primary Examiner* — Patrick King
(74) *Attorney, Agent, or Firm* — Workman Nydegger

(57) ABSTRACT

A maintenance unit including a liquid receiving portion that receives liquid, a discharging portion that discharges the liquid received by the liquid receiving portion into a waste liquid container, a common supporting member that supports the liquid receiving portion and the discharging portion, and a positioning portion that positions the waste liquid container.

6 Claims, 10 Drawing Sheets

(56) References Cited

U.S. PATENT DOCUMENTS

| | | | | |
|---|---|---|---|---|
| 2013/0182050 | A1* | 7/2013 | Aoki | B41J 2/1721 347/86 |
| 2014/0362139 | A1* | 12/2014 | Kanazawa | B41J 2/16511 347/29 |
| 2015/0251427 | A1* | 9/2015 | Sugahara | B41J 2/16505 347/29 |
| 2015/0314605 | A1* | 11/2015 | Hirasawa | B41J 2/1721 347/36 |
| 2015/0375509 | A1* | 12/2015 | Harada | B41J 2/16517 347/36 |

* cited by examiner

MAINTENANCE UNIT AND LIQUID EJECTING APPARATUS

BACKGROUND

1. Technical Field

The present invention relates to a maintenance unit and a liquid ejecting apparatus.

2. Related Art

Ink jet printers have been known as an example of a liquid ejecting apparatus that perform printing on paper (recording media) by ejecting ink (liquid) from an ink jet head (liquid ejecting head). For example, JP-A-2007-296757 describes a liquid ejecting apparatus provided with a maintenance unit that discharges thickened liquid, air bubbles, and foreign substances from the liquid ejecting head along with the liquid for the purpose of resolving ejecting failures of the liquid from the liquid ejecting head.

JP-A-2007-296757 describes technique aimed at enabling maintenance work to be easily and inexpensively performed on a maintenance unit. The maintenance unit described in JP-A-2007-296757 includes a unit frame that holds a pump, and a pump tube that is provided for the pump and connected to a waste liquid tank (waste liquid container). The pump tube is divided and interconnected by a tube joint provided on the unit frame, and the tube joint is disposed at a position at which the tube joint is exposed from the platform in a state where an outer cover is removed.

With the technique described above, the maintenance unit and the waste liquid container are connected via a tube and, consequentially, both the maintenance unit and the waste liquid container have to be positioned with respect to the liquid ejecting apparatus body in order to ensure positional accuracy thereof. Moreover, when replacing either of the maintenance unit and the waste liquid container, extra effort in maintenance was required as it was necessary to remove the tube after releasing the positioning, on the liquid ejecting apparatus, of the part to be replaced.

SUMMARY

An advantage of some aspects of the invention is that a liquid ejecting apparatus and a maintenance unit are provided whereby separation from the waste liquid container is easy and replacement work is effortless.

According to an aspect of the invention, a maintenance unit has a configuration including a liquid receiving portion that receives liquid, a discharging portion that discharges the liquid received by the liquid receiving portion into a waste liquid container, a common supporting member that supports the liquid receiving portion and the discharging portion, and a positioning portion that positions the waste liquid container.

According to this configuration, the liquid receiving portion and the discharging portion are integrated by the common supporting member and the waste liquid container is positioned by the positioning portion provided in the maintenance unit. As a result, there is no need to position the waste liquid container with respect to the liquid ejecting apparatus, and because the liquid receiving portion and the discharging portion can be mounted and detached together, separation from the waste liquid container is easy.

According to another aspect of the invention, a liquid ejecting apparatus includes a liquid ejecting head that ejects liquid, the maintenance unit described above that maintains the liquid ejecting head, and an insertion/removal pathway through which the maintenance unit can be inserted/removed.

According to this configuration, the liquid ejecting apparatus is provided with the insertion/removal pathway through which the maintenance unit, in which the liquid receiving portion and the discharging portion are integrated, can be inserted/removed. As a result, maintenance is easy.

It is preferable that the liquid ejecting apparatus have a configuration that further includes a mounting portion that detachably mounts the waste liquid container.

According to this configuration, the liquid ejecting apparatus is provided with the mounting portion on which the waste liquid container can be detachably mounted. As a result, maintenance is easy in cases where the waste liquid container is replaceable.

It is preferable that the liquid ejecting apparatus have a configuration in which the discharging portion extends in a mounting direction of the waste liquid container on the mounting portion, and that the positioning portion be provided on the discharging portion.

According to this configuration, the positioning portion is provided on the discharging portion that extends in the mounting direction of the waste liquid container on the mounting portion. As a result, the waste liquid container can be positioned with respect to the maintenance unit at the same time that the waste liquid container is mounted on the mounting portion.

It is preferable that the liquid ejecting apparatus have a configuration in which the waste liquid container includes a container side terminal portion, the mounting portion includes an apparatus side terminal portion that is electrically connectible to the container side terminal portion, and the apparatus side terminal portion is movable in a direction intersecting a mounting direction of the waste liquid container on the mounting portion.

According to this configuration, in a structure where the waste liquid container is positioned with respect to the maintenance unit, the apparatus side terminal portion provided on the mounting portion moves in the direction intersecting the mounting direction of the waste liquid container and thereby, absorbs positional deviation between the mounting portion and the liquid ejecting apparatus body where the waste liquid container is not positioned. Therefore, the electrical connection between the container side terminal portion and the apparatus side terminal portion can be ensured.

It is preferable that the liquid ejecting apparatus have a configuration in which the discharging portion extends in an insertion/removal direction of the maintenance unit in the insertion/removal pathway.

According to this configuration, contact of the liquid ejecting apparatus with the discharging portion can be avoided when inserting/removing the maintenance unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
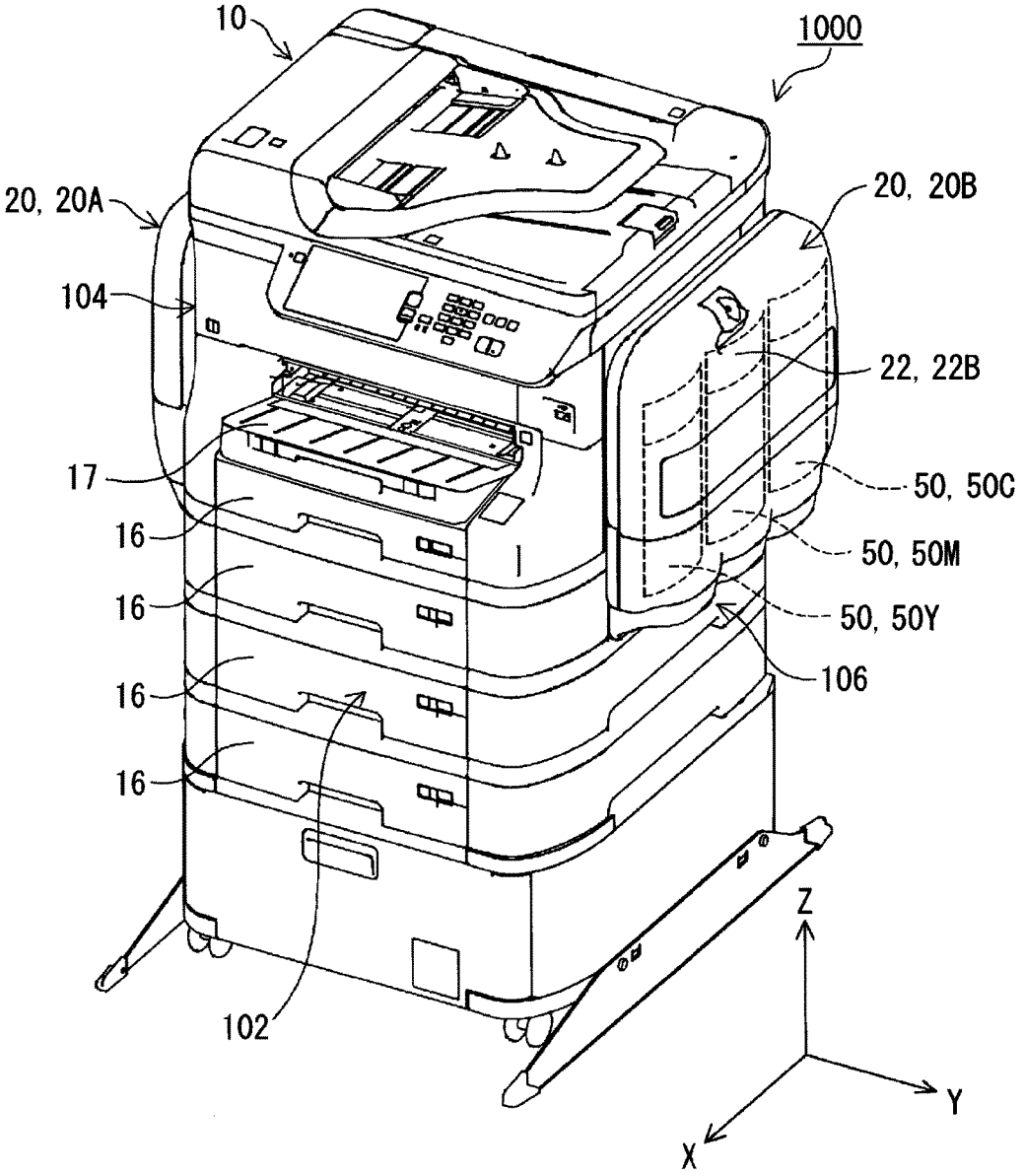
FIG. 1 is a perspective view illustrating an overall appearance of a liquid ejecting apparatus according to an embodiment of the invention.

Hereinafter, embodiments of a maintenance unit and a liquid ejecting apparatus according to the invention will be described while referencing the drawings. In the drawings used in the following description, the scale of each constituent is appropriately adjusted to a recognizable size.

Figure 2:
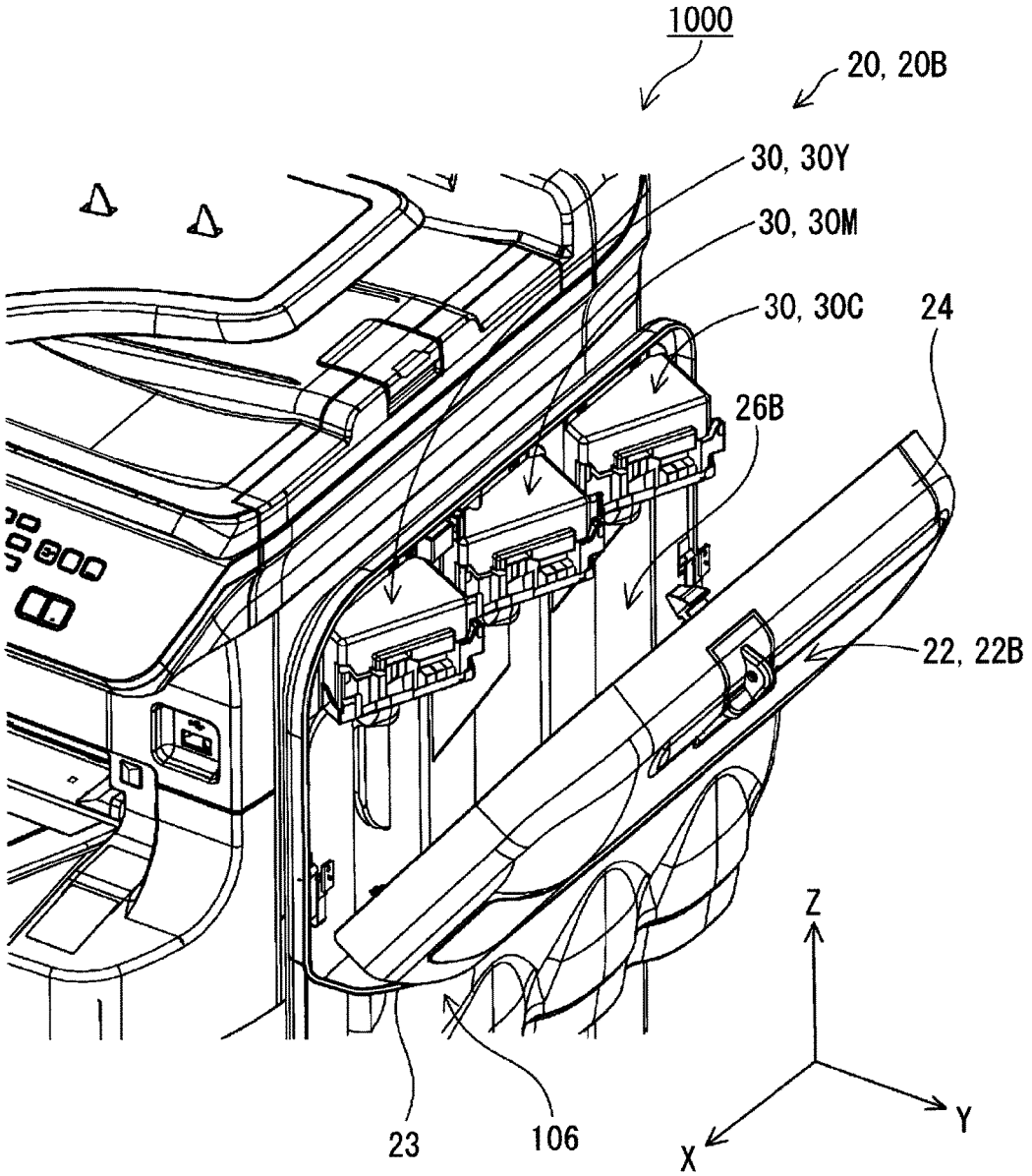
FIG. 2 is a perspective view illustrating the liquid ejecting apparatus according to an embodiment of the invention, in a state where a side portion is opened.

FIG. 1 is a perspective view illustrating an overall appearance of a liquid ejecting apparatus 1000 according to an embodiment of the invention. FIG. 2 is a perspective view illustrating the liquid ejecting apparatus 1000 according to an embodiment of the invention, in a state where a side portion is opened.

Note that, in FIGS. 1 and 2, an XYZ orthogonal coordinate system is set. In the liquid ejecting apparatus 1000, a front/rear direction is the X-axis direction, a direction orthogonal to the X-axis direction in the horizontal plane is the Y-axis direction (horizontal direction), and a direction (vertical direction) orthogonal to each of the X-axis direction and the Y-axis direction is the Z-axis direction.

As illustrated in FIG. 1, the liquid ejecting apparatus 1000 includes an apparatus body 10 and two liquid supplying devices 20. In a state of usage of the liquid ejecting apparatus 1000, the apparatus body 10 is set on a horizontal plane defined by the X-axis direction and the Y-axis direction. The liquid supplying devices 20 supply ink as liquid to the apparatus body 10. A liquid container 50 that contains liquid is detachably connected (mounted) to the liquid supplying devices 20. In the present embodiment, a pack-type container in which liquid is stored is used as the liquid container 50.

The apparatus body 10 is an ink jet printer. The apparatus body 10 is provided with a paper feeding tray 16 and a discharge tray 17. The paper feeding tray 16 and the discharge tray 17 are provided on an apparatus front face 102 of the apparatus body 10. The paper feeding tray 16 is provided in plurality at positions of different heights in a vertical direction. Recording media (e.g. paper), on which text and similar images are to be printed (recorded) by the apparatus body 10, is stored in the paper feeding tray 16. Recording media on which images have been recorded by the apparatus body 10 is discharged on the discharge tray 17.

The two liquid supplying devices 20 are provided on an apparatus left side 104 and on an apparatus right side 106 of the apparatus body 10. The liquid supplying device 20 provided on the apparatus left side 104 is called first liquid supplying device 20A, and the liquid supplying device 20 provided on the apparatus right side 106 is called second liquid supplying device 20B. Note that in cases where the first and second liquid supplying devices 20A and 20B are used without differentiating between them, the first and second liquid supplying devices 20A and 20B are simply called the liquid supplying devices 20.

The liquid supplying devices 20 include a case member 22, the liquid container 50, and an attachment unit 30 (FIG. 2). One of the liquid container 50 and one of the attachment unit 30 are housed in the first liquid supplying device 20A (FIG. 3, described later), and three of the liquid container 50 and three of the attachment unit 30 are housed in the second liquid supplying device 20B. Note that the number of the liquid container 50 and the number of the attachment unit 30 are examples.

Types of liquid that are different from each other are stored (filled) in the four liquid containers 50. In the present embodiment, yellow (Y), magenta (M), cyan (C), and black (K) liquids are each stored respectively in the four liquid containers 50. A liquid container 50K in which the black liquid is stored (FIG. 3, described later) is housed in a housing space 26A inside a case member 22A (third case member) of the first liquid supplying device 20A. A liquid container 50C in which the cyan liquid is stored, a liquid container 50M in which the magenta liquid is stored, and a liquid container 50Y in which the yellow liquid is stored are housed in a housing space 26B (FIG. 2) inside a case member 22B (second case member) of the second liquid supplying device 20B.

The attachment unit 30 is detachably mounted on the liquid container 50. As illustrated in FIG. 2, the attachment unit 30C is mounted on the liquid container 50C, the attachment unit 30M is mounted on the liquid container 50M, and the attachment unit 30Y is mounted on the liquid container 50Y. The attachment unit 30 is arranged inside the case member 22. When the attachment unit 30 is mounted on the liquid container 50, the liquid stored in the liquid container 50 is supplied to a liquid ejecting head 60 (FIG. 3, described later) of the apparatus body 10 by a feeding mechanism (not illustrated) having a pump function provided in the apparatus body 10.

As illustrated in FIG. 2, the case member 22 is configured to open and close by rotating a second edge portion 24 that has a first edge portion 23 rotatably connected to the apparatus body 10 as a fulcrum. After the liquid stored in the liquid container 50 has been consumed, a user opens the case member 22 and removes the consumed liquid container 50 from the attachment unit 30. Then, the user mounts a new liquid container 50 on the attachment unit 30 and, thereafter, closes the case member 22.

Figure 3:
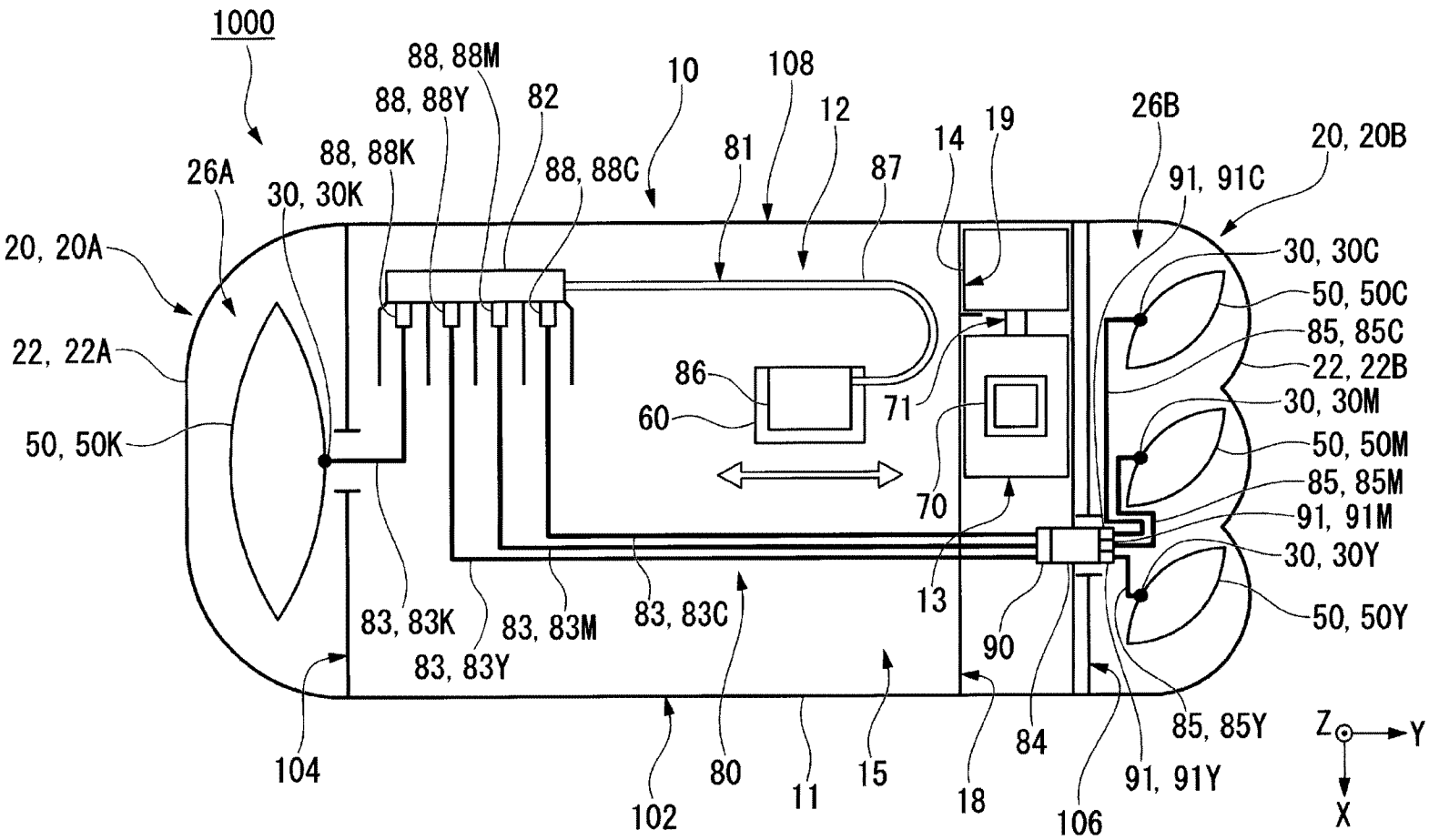
FIG. 3 is a schematic configuration diagram of an interior of the liquid ejecting apparatus according to an embodiment of the invention.

FIG. 3 is a schematic configuration diagram of an interior of the liquid ejecting apparatus 1000 according to the embodiment of the invention. As illustrated in FIG. 3, the apparatus body 10 includes a case member 11 (first case member), a liquid ejecting unit 12, a maintenance unit 13, and a waste liquid container 14. The liquid ejecting unit 12, the maintenance unit 13, and the waste liquid container 14 are housed in a housing space 15 inside the case member 11. The case member 11 includes an insertion/removal pathway 18 through which the maintenance unit 13 can be inserted/removed, and a mounting portion 19 on which the waste liquid container 14 is detachably mounted.

The liquid ejecting unit 12 prints images on the recording media by ejecting liquid while moving the liquid ejecting head 60 in the Y-axis direction (primary scanning direction), while simultaneously transporting the recording media in the X-axis direction (secondary scanning direction) using a transporting device (not illustrated). The liquid ejecting head 60 is an ink jet head and, for example, drives a plurality of piezoelectric vibrator to eject liquid from a plurality of nozzles. Nozzle rows are formed in the liquid ejecting head 60 for each type of liquid.

A region called a home position is provided at a position outside a printing region to which the liquid ejecting head 60 is moved in the primary scanning direction and, the maintenance unit 13 that performs maintenance to ensure normal printing is disposed at the home position. The maintenance unit 13 includes a liquid receiving portion 70 that receives liquid from the liquid ejecting head 60, and a discharging portion 71 that discharges the liquid received by the liquid receiving portion 70 into the waste liquid container 14.

As illustrated in FIG. 3, the liquid ejecting apparatus 1000 includes a liquid supply system 80 that supplies liquid from the liquid container 50 to the liquid ejecting head 60. The liquid supply system 80 includes a head flow path 81, a first relay portion 82, first flow paths 83, a second relay portion 84, and second flow paths 85. The head flow path 81 includes a coupling member 86 that connects to the liquid ejecting head 60, and a multi-row flexible tubing 87 in which flow paths for each of the types of liquid are formed. A first end of the head flow path 81 is connected to the liquid ejecting head 60 and a second end of the head flow path 81 is connected to the first relay portion 82.

The first relay portion 82 connects the head flow path 81 with the first flow paths 83, and is housed in the housing space 15 inside the case member 11.

The first flow paths 83 are provided in plurality for each type of liquid. A first flow path 83K through which black liquid flows is a liquid supply tube that constitutes a connection between the first relay portion 82 and the attachment unit 30K. The first flow path 83K includes a coupling member 88 (referred to as "coupling member 88K") that connects to the first relay portion 82. As distance to the first relay portion 82 is short, the first flow path 83K directly connects the first relay portion 82 with the attachment unit 30K.

First flow paths 83C, 83M, and 83Y through which cyan, magenta, and yellow liquid respectively flow are liquid supply tubes that each constitute a connection between the first relay portion 82 and the second relay portion 84. The first flow paths 83C, 83M, and 83Y each include the coupling member 88 (referred to as "coupling members 88C, 88M, and 88Y", respectively) that connects to the first relay portion 82, and a common coupling member 90 that connects to the second relay portion 84.

The second relay portion 84 connects each of the first flow paths 83 with a corresponding one of the first flow paths 85, and is provided across the case member 11 and the case member 22B.

The second flow paths 85 are provided in plurality for each of the cyan, magenta, and yellow liquids. Second flow paths 85C, 85M, and 85Y through which cyan, magenta, and yellow liquid respectively flow are liquid supply tubes that each constitute a connection between the second relay portion 84 and the attachment units 30C, 30M, and 30Y. The second flow paths 85C, 85M, and 85Y include coupling members (referred to as "coupling members 91C, 91M, and 91Y") that connect to the second relay portion 84.

Figure 4:
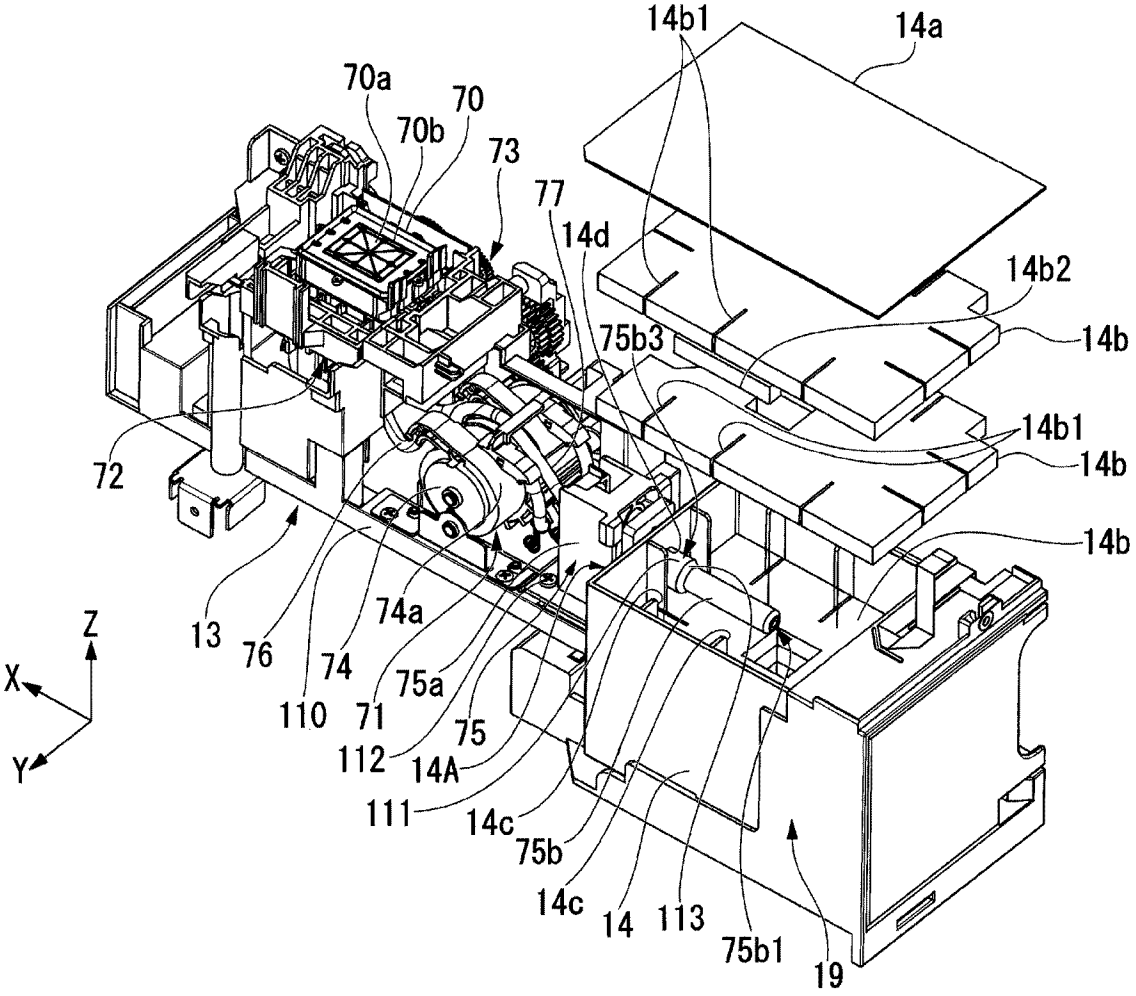
FIG. 4 is a perspective view illustrating a state where a maintenance unit and a waste liquid container according to an embodiment of the invention are connected.
Figure 5:
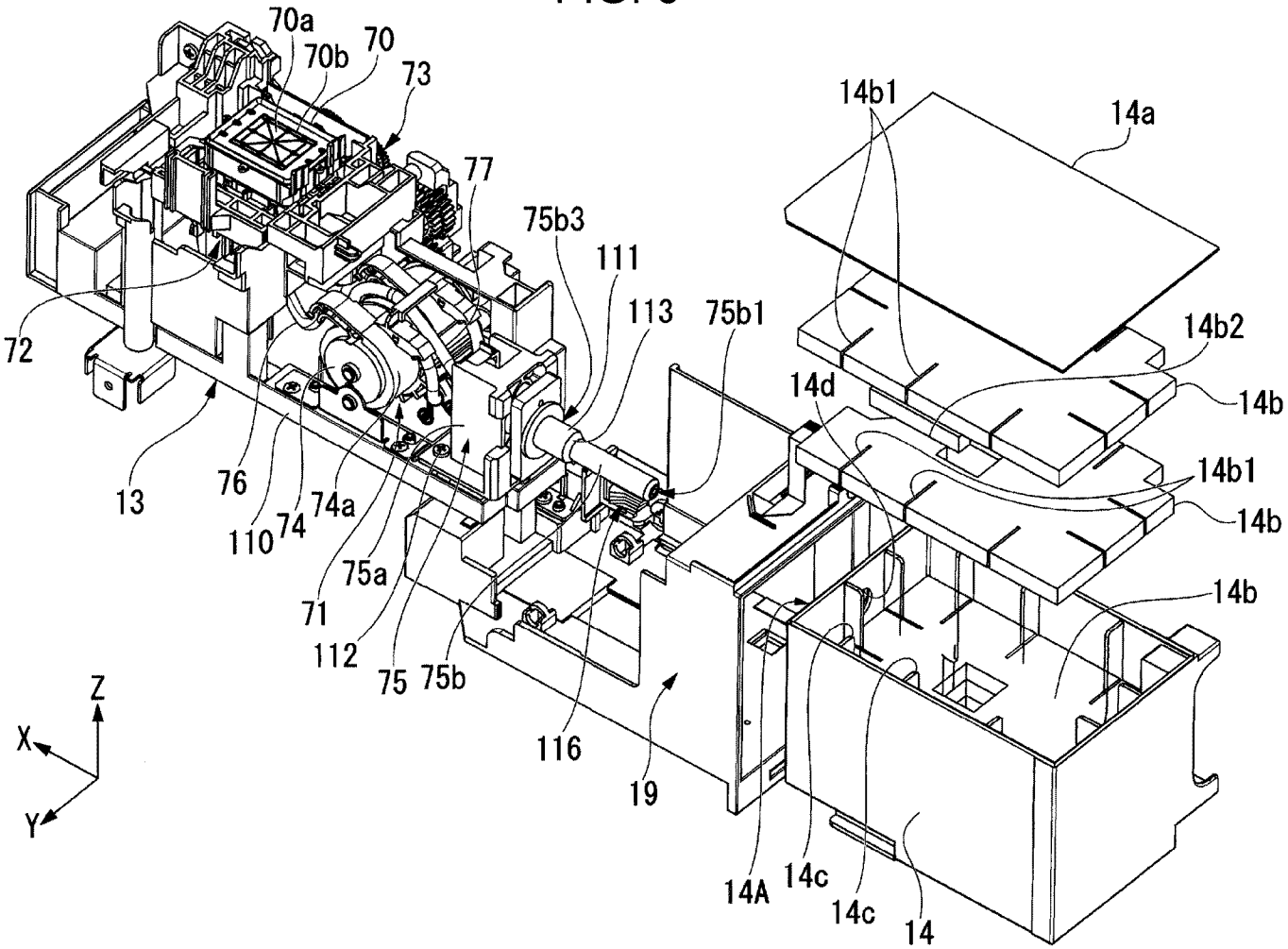
FIG. 5 is a perspective view illustrating a state where the maintenance unit and the waste liquid container according to an embodiment of the invention are separated.
Figure 6:
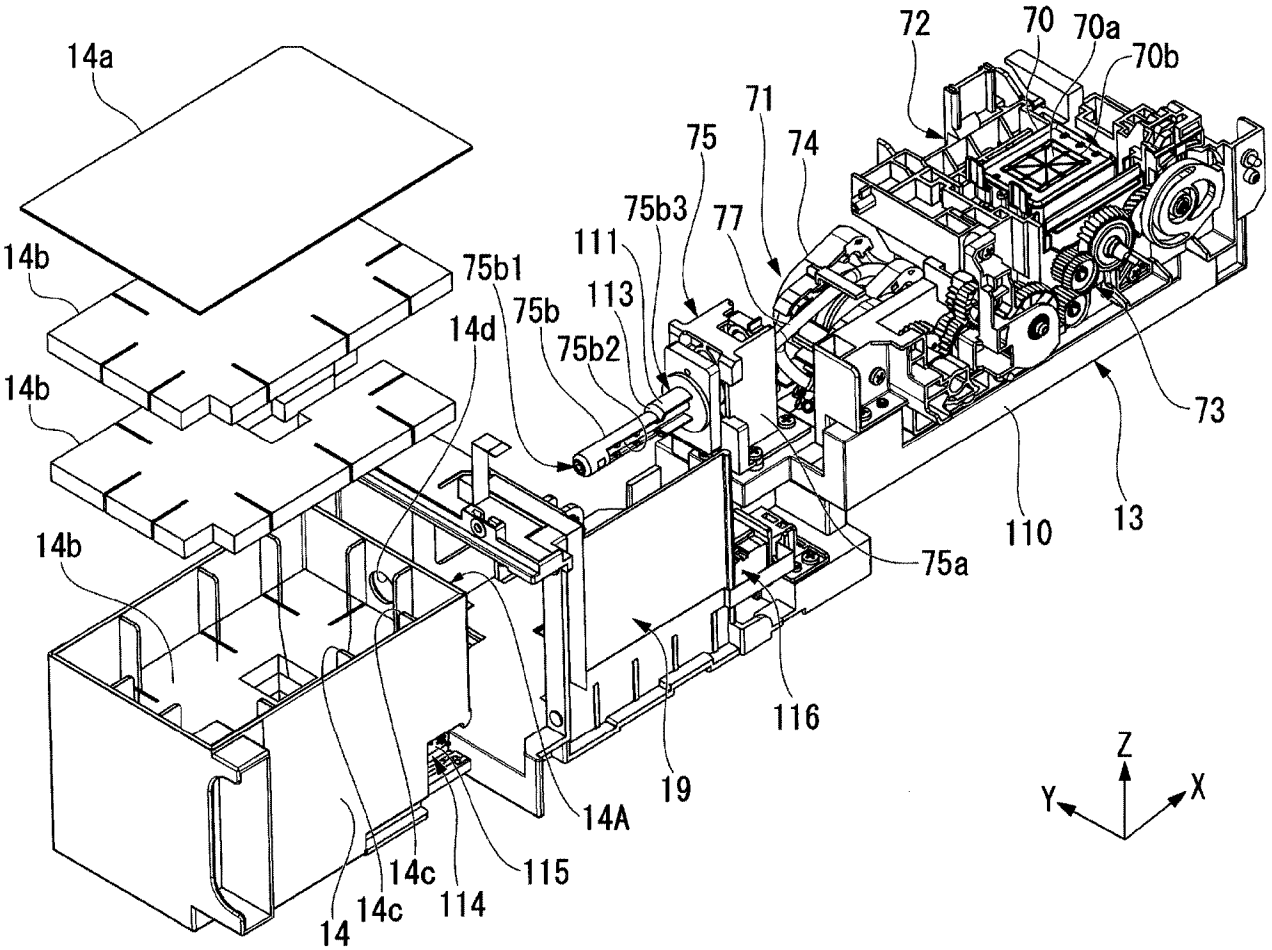
FIG. 6 is a perspective view illustrating a state where the maintenance unit and the waste liquid container according to an embodiment of the invention are separated.
Figure 7:
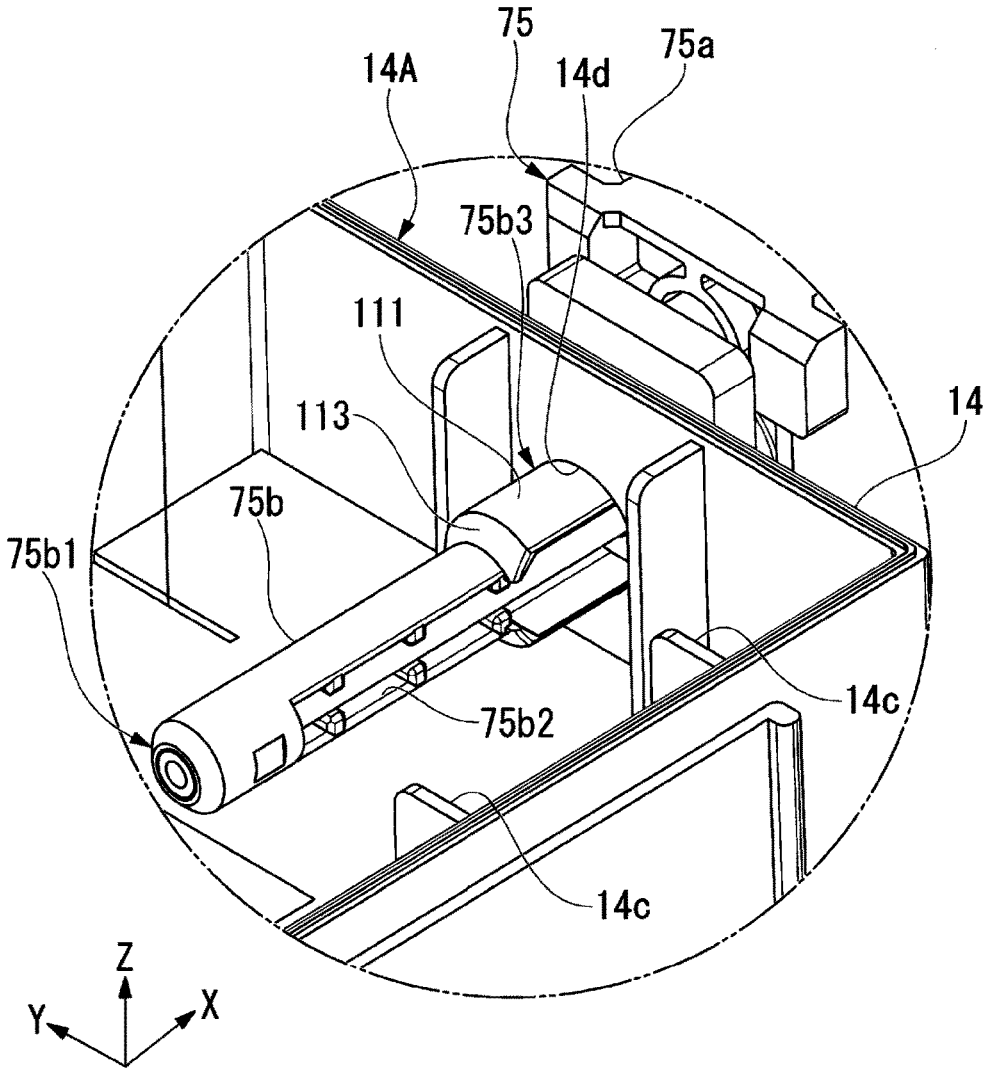
FIG. 7 is an enlarged view of a positioning portion provided on the maintenance unit according to an embodiment of the invention.

FIG. 4 is a perspective view illustrating a state where the maintenance unit 13 and the waste liquid container 14 according to the embodiment of the invention are connected. FIGS. 5 and 6 are perspective views illustrating states where the maintenance unit 13 and the waste liquid container 14 according to the embodiment of the invention are separated. FIG. 7 is an enlarged view of a positioning portion 111 provided on the maintenance unit 13 according to the embodiment of the invention.

As illustrated in FIG. 5, the maintenance unit 13 includes a common supporting member 110 that supports the liquid receiving portion 70 and the discharging portion 71, and a positioning portion 111 for positioning the waste liquid container 14.

The liquid receiving portion 70 is a cap member that is pressed, by a lifting/lowering mechanism 72 provided with a cam or the like, against a nozzle surface where a nozzle of the liquid ejecting head 60 is formed and forms a closed space so as to enclose the nozzle. The liquid receiving portion 70 has a box-like shape with a top side thereof open, and includes therein an absorbent material 70*a* that absorbs liquid and a pressing member 70*b* that holds the absorbent material 70*a* down.

The discharging portion 71 is a pump device that discharges liquid by introducing negative pressure to the closed space formed by the liquid receiving portion 70 being pressed against the nozzle surface of the liquid ejecting head 60. The discharging portion 71 includes a pump body 74, a coupling member 75, a tubing 76 that connects an inlet of the pump body 74 with the liquid receiving portion 70, and a tubing 77 that connects an outlet of the pump body 74 with the coupling member 75.

The pump body 74 is a so-called tube pump. The pump body 74 includes a pump case 74*a* that has an arc-shaped inner wall surface, a tubing (not illustrated) housed in an arc-shape along the inner wall surface of the pump case 74*a*, and a roller (not illustrated) that revolves while pressing on the arcuate portion of the tubing. The liquid is suctioned out of the liquid receiving portion 70 due to the roller rotating while collapsing the tubing. Note that the pump body 74 and the lifting/lowering mechanism 72 are driven by a gear mechanism 73 illustrated in FIG. 6. The gear mechanism 73 is connected to a driving motor (not illustrated).

As illustrated in FIG. 5, the coupling member 75 includes a column member 75*a* erected on the common supporting member 110, and a nozzle member 75*b* protruding in the horizontal direction from the column member 75*a*. The column member 75*a* has a roughly rectangular block like shape, and is fixed to the common supporting member 110 by a plurality of fixing members 112. The fixing members 112 are screw members. The nozzle member 75*b* is supported at a predetermined height by the column member 75*a*. The nozzle member 75*b* is connected to the tubing 77 and introduces the liquid suctioned by the pump body 74 from a tip portion 75*b*1 to the waste liquid container 14. Additionally, a hollow groove 75*b*2 (FIG. 6) is formed in a side portion of the nozzle member 75*b*.

As illustrated in FIG. 5, the waste liquid container 14 has a box like shape with a top side thereof open, and includes a sealing member 14*a* for sealing the opening, and absorbent materials 14*b* that absorb liquid. A plurality of vertical ribs 14*c* is formed in the waste liquid container 14. The absorbent materials 14*b* are a porous material such as sponge or the like. The absorbent materials 14*b* have slits 14*b*1 into which the vertical ribs 14*c* are inserted and are stacked inside the waste liquid container 14. A notch groove 14*b*2 in which the nozzle member 75*b* is disposed is formed in at least one of the stacked absorbent materials 14*b*.

As described above, the liquid ejecting apparatus 1000 includes the insertion/removal pathway 18 (FIG. 3) through which the maintenance unit 13 can be inserted/removed. As illustrated in FIG. 5, the liquid receiving portion 70 and the discharging portion 71 that constitute the maintenance unit 13 are integrated (unitized) via the common supporting member 110. The common supporting member 110 is a lower frame supporting the liquid receiving portion 70 and the discharging portion 71, and has a configuration in which the common supporting member 110 can be fixed to (can be positioned on) the apparatus body 10 by screw fixing or the like at a predetermined position of the insertion/removal pathway 18 through which insertion and removal is possible.

The discharging portion 71 extends in the insertion/removal direction (the X-axis direction) of the maintenance unit 13 in the insertion/removal pathway 18. Specifically, the discharging portion 71 is disposed such that the pump body 74 and the coupling member 75 form a row along the insertion/removal direction on the common supporting member 110, and the tip portion 75*b*1 of the nozzle member 75*b* of the coupling member 75 is protrudes from the common supporting member 110 in the insertion/removal direction. That is, when the maintenance unit 13 is inserted into the insertion/removal pathway 18, the common supporting member 110 supports, in order, the coupling member 75, the pump body 74, and the liquid receiving portion 70, with the coupling member 75 leading out.

Additionally, as described above, the liquid ejecting apparatus 1000 includes the mounting portion 19 (FIG. 3) on which the waste liquid container 14 is detachably mounted. The mounting portion 19 is provided on the extending line of the insertion/removal pathway 18 and a portion thereof is in communication with the insertion/removal pathway 18. The insertion/removal pathway 18 allows the insertion/removal of the maintenance unit 13 from the apparatus front face 102 of the apparatus body 10, and the mounting portion 19 forms a recessed space where the waste liquid container 14 is mounted so as to be detachable from the apparatus rear face 108 of the apparatus body 10. That is, in the present embodiment, the insertion/removal direction of the maintenance unit 13 and the mounting direction of the waste liquid container 14 are both the X-axis direction.

As described above, the discharging portion 71 extends in the mounting direction (the X-axis direction) and, as illustrated in FIG. 5, the positioning portion 111 is provided on the discharging portion 71 that extends in the mounting direction. Specifically, the nozzle member 75*b* of the coupling member 75 that extends in the X-axis direction, and that leads out when the maintenance unit 13 is being inserted, is provided on the positioning portion 111. The positioning portion 111 is disposed on a base portion 75*b*3 of the nozzle member 75*b*. The positioning portion 111 has a cylindrical shape with an outer circumferential surface that is slightly larger than an outer circumferential surface of the tip portion 75*b*1 of the nozzle member 75*b*. Additionally, a taper portion 113 (guide portion) that gradually increases in diameter is formed between the positioning portion 111 and the tip portion 75*b*1.

On the other hand, the waste liquid container 14 includes a connection port 14*d* through which the nozzle member 75*b* is inserted. The connection port 14*d* is formed on a side surface 14A of the waste liquid container 14 that faces the nozzle member 75*b* (side surface facing into the mounting portion 19). The connection port 14*d* has an outer diameter that is roughly the same as an outer diameter of the positioning portion 111 and, as illustrated in FIG. 7, is configured so that a peripheral portion of the positioning portion 111 (portion excluding the hollow groove 75*b*2) contacts the connection port 14*d* when the nozzle member 75*b* is inserted completely. Thus, the waste liquid container 14 is positioned with respect to the maintenance unit 13 on the Y and Z planes that intersect the X-axis direction due to the connection port 14*d* and the positioning portion 111 contacting in a circumferential direction.

As illustrated in FIG. 6, a recessed portion 114 is formed in a lower edge corner of the side surface 14A side of the waste liquid container 14. A container side terminal portion 115 is disposed in the recessed portion 114. The container side terminal portion 115 has a recording element that records an amount of liquid or the like introduced into the waste liquid container 14.

On the other hand, as illustrated in FIG. 5, the mounting portion 19 has an apparatus side terminal portion 116 that is electrically connectible to the container side terminal portion 115. The apparatus side terminal portion 116 is a connection element for performing reading/writing of information from/to the container side terminal portion 115. The apparatus side terminal portion 116 is disposed at a position where connection in the Y-axis direction with the container side terminal portion 115 is possible.

Figure 8:
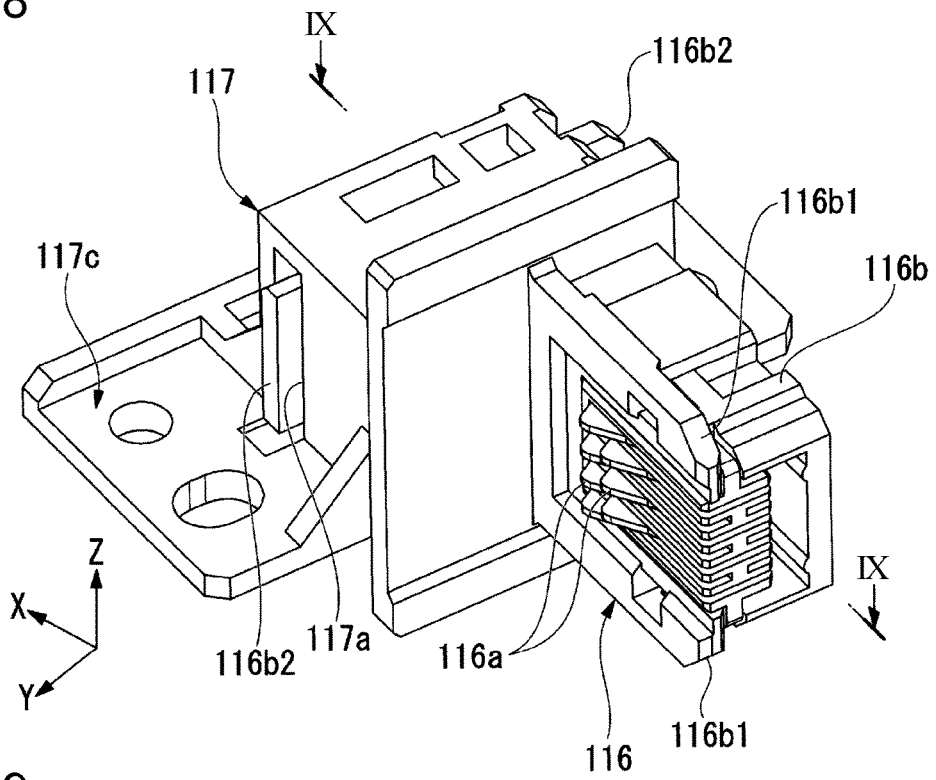
FIG. 8 is a perspective view illustrating a configuration of an apparatus side terminal portion according to an embodiment of the invention.
Figure 9:
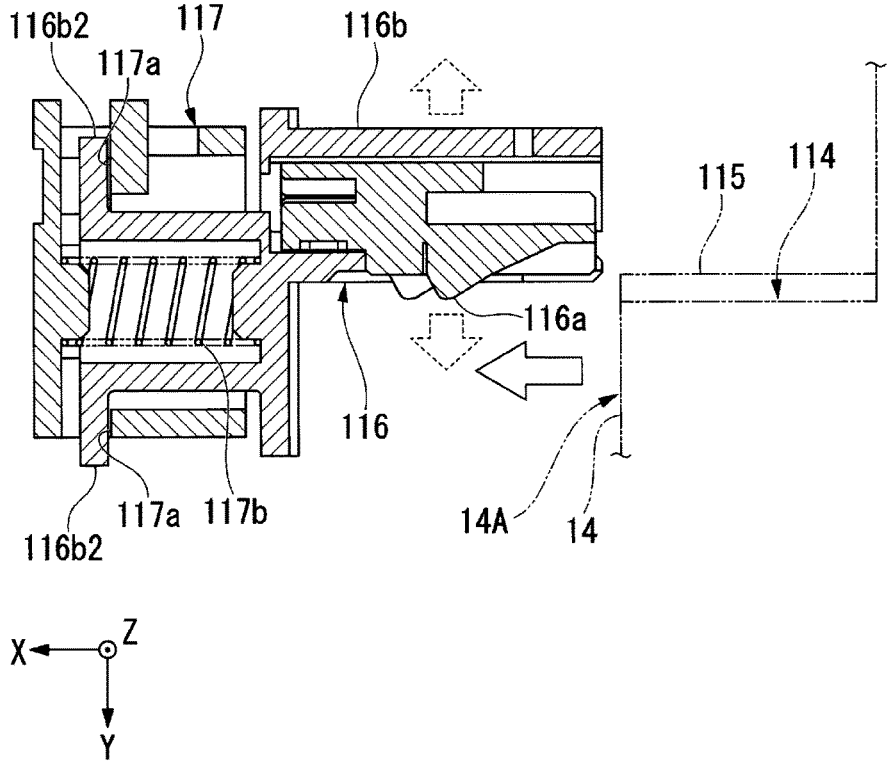
FIG. 9 is a cross-sectional view taken along IX-IX of FIG. 8.

FIG. 8 is a perspective view illustrating a configuration of the apparatus side terminal portion 116 according to the embodiment of the invention. FIG. 9 is a cross-sectional view taken along IX-IX of FIG. 8.

As illustrated in FIGS. 8 and 9, the apparatus side terminal portion 116 is supported on a floating unit 117, and is configured to be movable on the mounting portion 19 in directions (the Y-axis direction and the Z-axis direction) intersecting the mounting direction (the X-axis direction) of the waste liquid container 14.

The apparatus side terminal portion 116 includes a plurality of connecting terminals 116*a* that connect to the container side terminal portion 115, and a holder 116*b* that holds the plurality of connecting terminals 116*a*. As illustrated in FIG. 8, a slanted guide portion 116*b*1 for guiding the holder 116*b* into the recessed portion 114 of the waste liquid container 14 is formed on the holder 116*b*. Additionally, as illustrated in FIG. 9, the holder 116*b* includes an engaging portion 116*b*2 that movably engages with the floating unit 117 in a direction intersecting the X-axis direction.

The floating unit 117 includes an engaged portion 117*a* that engages with the engaging portion 116*b*2 of the holder 116*b*, a spring member 117*b* that supports the holder 116*b* in a floating state, and a fixing portion 117*c* (FIG. 8) to be fixed to the mounting portion 19. As illustrated in FIG. 9, the engaged portion 117*a* engages with the engaging portion 116*b*2 with a gap in at least the Y-axis direction. The spring member 117*b* is a compression spring, biases the holder 116*b* in the X-axis direction, and allows movement of the apparatus side terminal portion 116 in the direction intersecting the X-axis direction while carrying out positioning in the X-axis direction by causing the engaging portion 116*b*2 to come in contact with the engaged portion 117*a*. The fixing portion 117*c* is fixed to the mounting portion 19 by screw fixing or the like.

Figure 10:
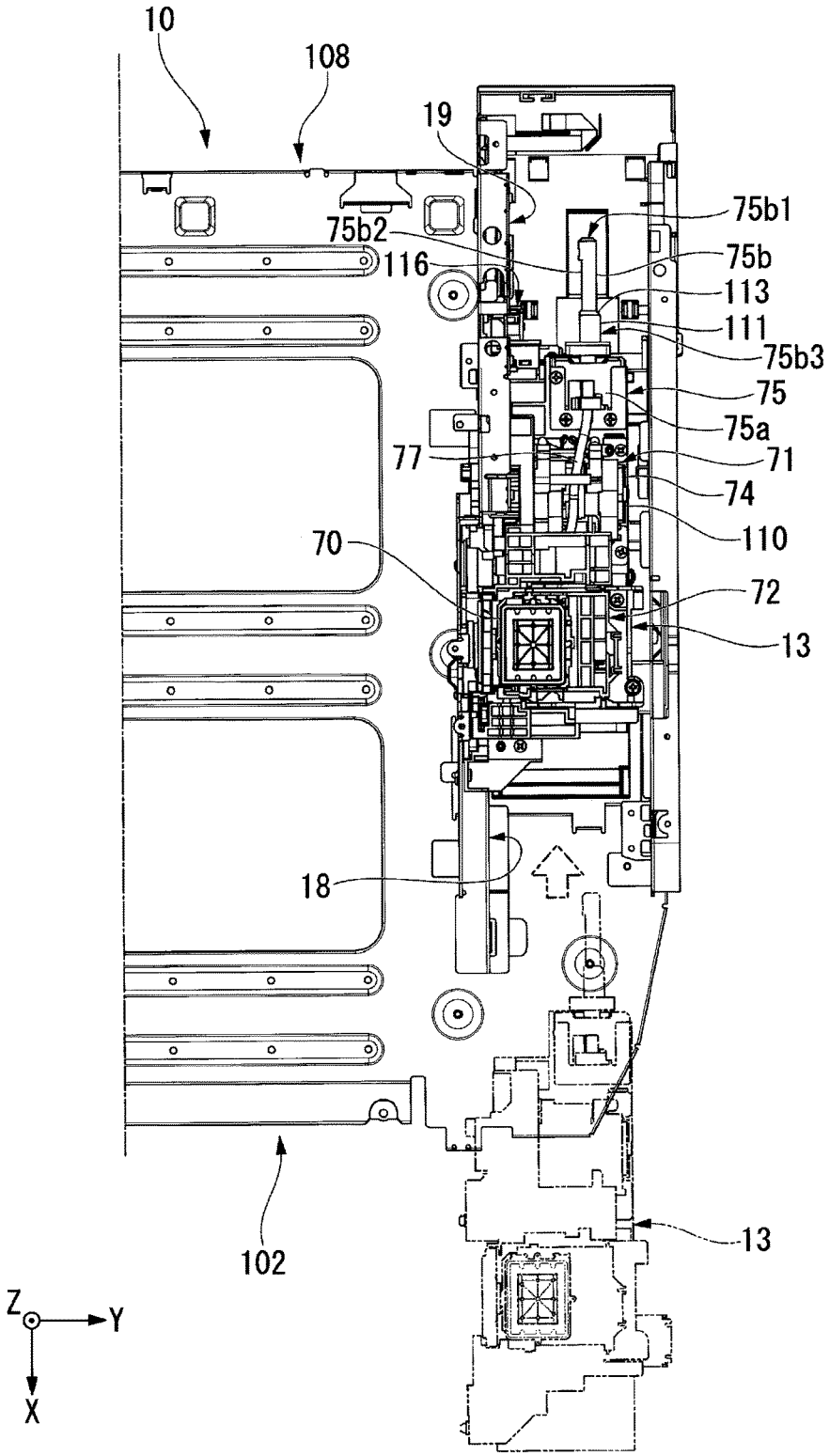
FIG. 10 is an explanatory drawing illustrating an appearance when the maintenance unit according to an embodiment of the invention is being inserted into the apparatus body.
Figure 11:
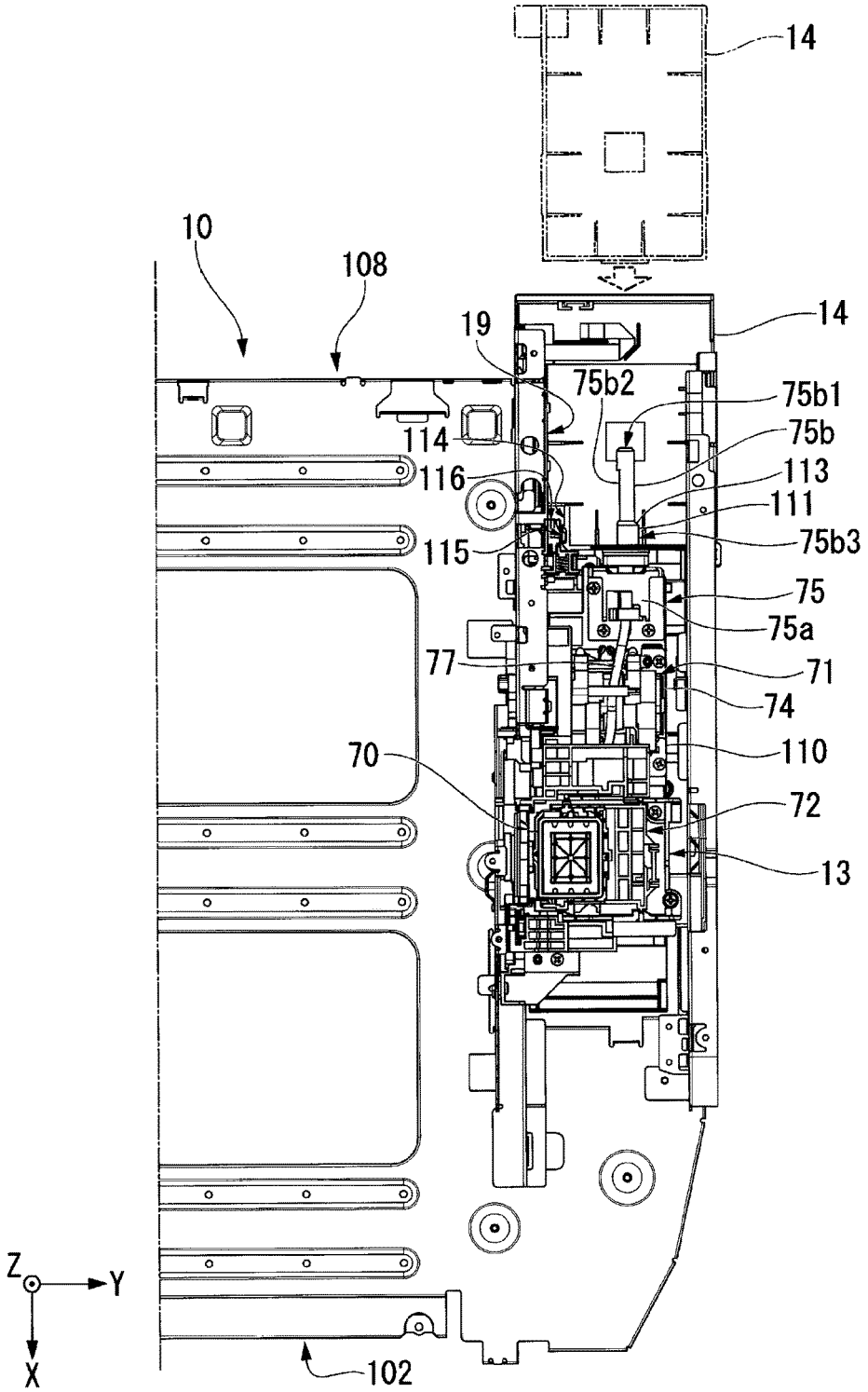
FIG. 11 is an explanatory drawing illustrating an appearance when the waste liquid container is being positioned with respect to the maintenance unit according to an embodiment of the invention.

Next, work to incorporate the maintenance unit 13 and the waste liquid container 14 in the apparatus body 10 is described while referencing FIGS. 10 and 11.

FIG. 10 is an explanatory drawing illustrating an appearance when the maintenance unit 13 according to the embodiment of the invention is being inserted into the apparatus body 10. FIG. 11 is an explanatory drawing illustrating an appearance when the waste liquid container 14 is being positioned with respect to the maintenance unit 13 according to the embodiment of the invention.

First, as illustrated in FIG. 10, the maintenance unit 13 is inserted into the apparatus body 10 from the apparatus front face 102 side. The apparatus body 10 includes, on the apparatus front face 102 side, the insertion/removal pathway 18 through which the maintenance unit 13 can be inserted/removed and, therefore, the maintenance unit 13, in which the liquid receiving portion 70 and the discharging portion 71 are integrated by the common supporting member 110, can be inserted. Thus, the work of incorporating is easy because the liquid receiving portion 70 and the discharging portion 71 can be inserted together. Additionally, when performing maintenance, the maintenance unit 13 can be removed as a complete unit via the insertion/removal pathway 18 and, therefore, replacement work is also easy.

Here, the discharging portion 71 extends in the insertion/removal direction (the X-axis direction) of the maintenance unit 13 in the insertion/removal pathway 18. According to this configuration, contact of the apparatus body 10 with the discharging portion 71 can be avoided when inserting or removing the maintenance unit 13. Specifically, the nozzle member 75*b* of the coupling member 75, which is provided so as to protrude from the common supporting member 110, can be inhibited from contacting the wall surface or the like forming the insertion/removal pathway 18 and, as a result, damage to the nozzle member 75*b* can be avoided.

After the maintenance unit 13 has been inserted to a predetermined position in the insertion/removal pathway 18, the common supporting member 110 of the maintenance unit 13 is screwed/fixed to the apparatus body 10. Thus, the maintenance unit 13 is positioned with respect to the apparatus body 10.

Next, as illustrated in FIG. 11, the waste liquid container 14 is connected to the maintenance unit 13 from the apparatus rear face 108 side. The apparatus body 10 includes, on the apparatus rear face 108, the mounting portion 19 on which the waste liquid container 14 detachably mounts and, thus, the waste liquid container 14 can be easily mounted. Therefore, assembly work is easy. Additionally, the waste liquid container 14 can be easily removed when performing maintenance and, therefore, in cases where replacing the waste liquid container 14 such as in the present embodiment, maintenance is easy.

When the waste liquid container 14 is mounted on the mounting portion 19, the waste liquid container 14 is positioned with respect to the maintenance unit 13. That is, as illustrated in FIG. 4, the maintenance unit 13 includes a positioning portion 111 for positioning the waste liquid container 14, and the positioning portion 111 is provided on the discharging portion 71 that extends in the mounting direction (the X-axis direction) of the waste liquid container 14 on the mounting portion 19. As such, the positioning portion 111 is provided on the discharging portion 71 that extends in the mounting direction of the waste liquid container 14 on the mounting portion 19 and, as a result, the waste liquid container 14 can be mounted on the mounting portion 19 and the waste liquid container 14 can be positioned with respect to the maintenance unit 13.

Specifically, the positioning portion 111 is provided on the nozzle member 75*b* that is inserted into the waste liquid container 14 and, when the nozzle member 75*b* is inserted into the connection port 14*d* of the waste liquid container 14, the peripheral portion of the positioning portion 111 contacts the connection port 14*d* in the circumferential direction. Thus, the waste liquid container 14 is positioned with respect to the maintenance unit 13 on the Y and Z planes that intersect the X-axis direction. Due to the fact that the taper portion 113 is formed on the nozzle member 75*b*, the connection port 14*d* of the waste liquid container 14 can be easily guided to the positioning portion 111. Note that positioning of the waste liquid container 14 in the X-axis direction is performed as a result of the waste liquid container 14 coming into contact with the coupling member 75 (specifically a flange of the nozzle member 75*b*).

In the present embodiment, the waste liquid container 14 is positioned by the positioning portion 111 provided on the coupling member 75 of the discharging portion 71 and, therefore, it is not necessary to position the waste liquid container 14 with respect to the apparatus body 10. Accordingly, the waste liquid container 14 can be easily separated from the maintenance unit 13. Additionally, in contrast with the existing technique described above, the waste liquid container 14 can be separated from and connected to the maintenance unit 13 without connecting using a tubing. As a result, replacement work when performing maintenance can be carried out simply and in a short period of time, leading to improvements in serviceability.

Additionally, when the waste liquid container 14 is mounted on the mounting portion 19, the container side terminal portion 115 and the apparatus side terminal portion 116 contact each other and, as a result, reading/writing of information from/to the recording element is possible. Here, as illustrated in FIG. 9, the apparatus side terminal portion 116 of the present embodiment has an aligning structure that is movable in the direction intersecting the mounting direction of the waste liquid container 14 on the mounting portion 19. According to this configuration, in the structure where the waste liquid container 14 is positioned with respect to the maintenance unit 13, the apparatus side terminal portion 116 provided on the mounting portion 19 moves in the direction intersecting the mounting direction of the waste liquid container 14 and, thereby, absorbs positional deviation between the mounting portion 19 of the apparatus body 10 and the waste liquid container 14. As a result, positional accuracy between the container side terminal portion 115 and the apparatus side terminal portion 116 can be ensured and connection failures between the container side terminal portion 115 and the apparatus side terminal portion 116 can be prevented.

Thus, according to the present embodiment described above, the maintenance unit 13 has a configuration including the liquid receiving portion 70 that receives liquid, the discharging portion 71 that discharges the liquid received by the liquid receiving portion 70 into the waste liquid container 14, the common supporting member 110 that supports the liquid receiving portion 70 and the discharging portion 71, and the positioning portion 111 that positions the waste liquid container 14. Therefore, separation of the maintenance unit 13 from the waste liquid container 14 is easy and replacement work is effortless. Additionally, according to the liquid ejecting apparatus 1000 of the present embodiment, serviceability is improved due to the fact that incorporation work and replacement work of the maintenance unit 13 and the waste liquid container 14 are easy.

A preferred embodiment of the invention has been described while referencing to drawings, but the invention is not limited to the embodiment. The shapes and combinations of the constituents described in the embodiment should not be construed to be more than an example, and various modifications based on design requirements and the like are possible without departing from the scope of the invention.

For example, in the embodiment described above, a configuration was described in which the positioning portion was provided on the coupling member of the discharging portion, but the positioning portion may be provided on a different portion. For example, a configuration is possible in which a protruding portion is provided on the common supporting member, and this protruding portion constitutes the positioning portion; and a recessed portion that engages with this positioning portion is formed on in the waste liquid container.

Additionally, in such a configuration, in a cases where, for example, the waste liquid container is a stationary-type waste liquid container provided on the apparatus body, a configuration is possible in which an aperture is provided in a portion of the waste liquid container and the discharging portion (the tip portion of the nozzle member) is positioned above the aperture when the maintenance unit is fixed to the apparatus body.

Additionally, configurations are possible in which, for example, the maintenance unit can be inserted/removed in a state where the waste liquid container is mounted on the mounting portion, or the maintenance unit can be inserted/removed by removing the waste liquid container 14.

Additionally, for example, in the embodiment described above, a configuration was described in which the maintenance unit can be inserted/removed from the apparatus front face and the waste liquid container can be mounted/removed from the apparatus back face; but configurations are possible in which the maintenance unit can be inserted/removed from the apparatus right side face, the apparatus left side face, the apparatus rear face, and the apparatus top face and, additionally, configurations are possible in which the waste liquid container can be mounted/removed from the apparatus front face, the apparatus right side face, the apparatus left side face, and the apparatus top face. As the waste liquid container is expected to require replacement frequently, a configuration is particularly preferable in which the mounting portion of the waste liquid container is provided on the front face side of the apparatus body and the waste liquid container can be mounted/removed from the front face side of the apparatus body, and in which the maintenance unit can be inserted/removed from the rear face side or a side face side as replacement will be easy and serviceability will be improved.

Additionally, a configuration is possible in which, for example, the maintenance unit is inserted to the predetermined position in the insertion/removal pathway and, thereafter, the maintenance unit is fixed in the insertion/removal pathway using a screw or the like. According to such a configuration, it is possible to restrict the insertion/removal and fixing of the maintenance unit to a single direction (e.g. the X-axis direction) and components to be removed such as outer coverings of case members and the can be kept to a minimum. As a result, serviceability will improve. However, configurations are also possible in which the maintenance unit can be fixed in directions other than the insertion/removal direction, or the maintenance unit can be fixed in multiple directions.

Additionally, a configuration is possible in which, for example, a portion of the maintenance unit forms a portion of the outer covering of the case member. In such a configuration, the components to be removed in order to insert/remove the maintenance unit can be reduced or eliminated.

Additionally, a configuration is possible in which, for example, the insertion/removal pathway of the maintenance unit includes a path, which causes the maintenance unit to move in a direction intersecting a primary insertion/removal direction, at a point along the primary insertion/removal direction. Here, the primary insertion/removal direction is the direction of greatest movement of the maintenance unit when being inserted/removed.

Additionally, a configuration is possible in which, for example, an absorbent material for absorbing liquid is laid on the common supporting member.

Additionally, a configuration is possible in which, for example, a gripping portion that is easily gripped by a user is formed on the common supporting member.

Additionally, a configuration is possible in which, for example, the maintenance unit includes a wiper for wiping the nozzle surface; a wiper cleaner for cleaning the wiper; a moistening mechanism formed in the closed space so as to surround the nozzle, for moistening the nozzle; a locking mechanism that stops the liquid ejecting head from moving in the Y-axis direction (the primary scanning direction); a flushing receiving member that receives liquid ejected from the liquid ejecting head that is not used in the recording; and the like.

Additionally, a configuration is possible in which, in cases where the liquid ejecting apparatus includes a plurality of liquid ejecting heads, the plurality of liquid ejecting heads is supported on the common supporting member.

Additionally, configurations are possible in which the liquid ejecting apparatus in the embodiment described above is a thermal jet printer or a line ink jet printer. Moreover, the liquid ejecting apparatus is not limited to a printer and may be a copier, a facsimile, or similar device.

Additionally, a configuration is possible in which the liquid ejecting apparatus ejects or discharges liquid other than ink. The invention is usable in any type of liquid ejecting apparatus that includes a liquid ejecting head or the like for discharging minute amounts of liquid droplets. Note that granular shaped liquid droplets, tear shaped liquid droplets, and thread shaped liquid droplets leaving a trail are included in the definition of "droplets" ejected from the liquid ejecting apparatus. Additionally, "liquid" as used herein, may be any material, provided that it can be ejected from the liquid ejecting apparatus. For example, the material may be any material in a state of liquid phase, and examples thereof include materials which flow such as liquids of high or low viscosity, sols, gel water, inorganic solvents, organic solvents, solutions, liquid resins, liquid metals (metallic melts), and the like. In addition, the term "liquid" includes not only the liquid state of a material, but also materials in which particles of a functional material which is formed of a solid body such as a pigment or metal particles are melted, or diffused, or mixed into a solvent. Representative examples of the liquid include the ink described in the embodiment described above. Herein, the term "ink" includes general water-based inks and oil-based inks, and also a variety of liquid compositions such as gel inks, hot-melt inks, and the like.

The entire disclosure of Japanese Patent Application No. 2015-218096, filed Nov. 6, 2015 is expressly incorporated by reference herein.

What is claimed is:

1. A liquid ejecting apparatus, comprising:

a liquid ejecting head that ejects liquid; and a maintenance unit, wherein the maintenance unit comprises:

a liquid receiving portion that receives liquid from the liquid ejecting head;

a discharging portion that discharges the liquid received by the liquid receiving portion into a waste liquid container; and a common supporting member that supports the liquid receiving portion and the discharging portion;

wherein the waste liquid container is detachably mounted on a mounting portion through a pathway that is different from a insertion/removal pathway through which the maintenance unit can be inserted/removed.

2. A liquid ejecting apparatus according to claim 1, wherein the discharging portion extends in a mounting direction of the waste liquid container on the mounting portion.

3. The liquid ejecting apparatus according to claim 1, wherein the maintenance unit includes a positioning portion that positions the waste liquid container.

4. The liquid ejecting apparatus according to claim 3, wherein:

the positioning portion is provided on the discharging portion.

5. The liquid ejecting apparatus according to claim 1, wherein:

the waste liquid container includes a container side terminal portion;

the mounting portion includes an apparatus side terminal portion that is electrically connectible to the container side terminal portion; and the apparatus side terminal portion is movable in a direction intersecting a mounting direction of the waste liquid container on the mounting portion.

6. The liquid ejecting apparatus according to claim 1, wherein:

the discharging portion extends in an insertion/removal direction of the maintenance unit in the insertion/removal pathway.

* * * * *